United States Patent [19]

Maruyama

[11] 4,259,307

[45] Mar. 31, 1981

[54] PROCESS FOR PRODUCING CARBON FIBERS

[75] Inventor: Kunio Maruyama, Okayama, Japan

[73] Assignees: Sumitomo Chemical Company, Limited; Japan Exlan Company, Ltd., both of Osaka, Japan

[21] Appl. No.: 115,275

[22] Filed: Jan. 25, 1980

[30] Foreign Application Priority Data

Jan. 26, 1979 [JP] Japan ..... 54-8456

[51] Int. Cl.[1] ..... D01F 9/22

[52] U.S. Cl. ..... 423/447.4; 264/29.2; 423/447.6

[58] Field of Search ..... 423/447.1, 447.6; 264/29.2

[56] References Cited

U.S. PATENT DOCUMENTS

| | | | |
|---|---|---|---|
| 3,817,700 | 6/1974 | Menikheim | 423/447.4 |
| 4,009,248 | 2/1977 | Kishimoto et al. | 423/447.4 |

FOREIGN PATENT DOCUMENTS

| | | | |
|---|---|---|---|
| 49-117724 | 11/1974 | Japan | 423/447.4 |

*Primary Examiner*—Edward J. Meros

*Attorney, Agent, or Firm*—Wenderoth, Lind & Ponack

[57] ABSTRACT

The present invention relates to a process for producing carbin fibers which involves thermally stabilizing and carbonizing or graphitizing acrylic fibers containing 0.1–5 weight %, based on the weight of the fibers, of a straight chain silicone substance and further containing 0.1–5 weight %, based on the weight of the fibers, of a chemical substance which is selected from glycerine, polyethylene glycol, polypropylene glycol, alkyl derivatives thereof, and mixtures or compounds of two or more of these substances, and which generates only a residue less than 5 weight % under the action of heat at 240° C. for one hour. According to applicant's invention, such problems as fluffiness, spreading, filament breakage etc. can be greatly reduced and it is possible to produce fibers free from agglutination or fusion and having high strength and high modulus of elasticity by heat-treatment in a short time.

9 Claims, No Drawings

PROCESS FOR PRODUCING CARBON FIBERS

BACKGROUND OF THE INVENTION

A. Field of the Invention

The present invention relates to an improved process for producing carbon fibers (hereinafter including graphite fibers also) which is excellent in operational stability, and more particularly to a process for producing carbon fibers which comprises thermally stabilizing and carbonizing acrylic fibers (including precursor fibers in filament form or in tow form) containing a predetermined amount of a straight chain silicone substance and a specific chemical substance, whereby high quality carbon fibers (carbon fiber filaments or tows) can be obtained and the operational stability in the step of heat treatment can be heightened.

B. Discussion of the Prior Art

It is already known that carbon fibers can be obtained by thermally stabilizing acrylic fibers in an oxidizing atmosphere at 200°-300° C., and then carbonizing the thus thermally stabilized fibers in a non-oxidizing atmosphere. However, what should be noted here is that the thermal stabilization reaction (oxidizing reaction) of acrylic fibers is an exothermal reaction, so that if the fibers are heated rapidly, local accumulation of heat takes place which is liable to cause an uneven reaction. Consequently, the fibers will fuse together or become brittle in the thermal stabilization step, and it is difficult to obtain high quality carbon fibers. Of course, various attempts have been made to remedy such technical defects. Such attempts include, for example, a method wherein the thermal stabilization is carried out at low temperatures for a long time, and a method wherein precursor fibers are impregnated with or caused to contain an organic silicone substance and then thermally stabilized, as described in Japanese Patent Laid-Open (Kokai) Application No. 117724/1974. However, in fact, these methods still involve unsolved problems. Namely, when the particular silicone substance as mentioned above is employed, the fusion or agglutination of acrylic fibers can be reduced to some extent, but on the other hand, owing to the water repellency of the silicone substance used, the acrylic fibers given such a substance tends to generate static electricity. When static electricity is generated, serious troubles such as fiber entanglement upon drawing out the fibers, winding of fibers around rollers or guides in the steps of thermal stabilization and carbonization, generation of fluff, etc. are caused and make the operation extremely unstable. To avoid such troubles, attempts were made to give the fibers antistatic spinning oils (anionic surface-active agents such as salts of higher fatty acids, higher alkyl sulfates, etc; cationic surface-active agents such as higher alkyl amine salts, etc.; nonionic surface-active agents such as condensation products of higher alkyl fatty acids with allyl alcohol or glycol) but when a usual spinning oil is used, it turns into a tar-like substance in the course of the thermal stabilization step, and a large amount of the heat-decomposed substance remains on the surface of the fibers. Therefore, the phenomenon of fiber fusion or agglutination occurs again and disadvantages such as fiber breakage, etc. are caused. Among others, when an acrylic fiber tow produced by wet-spinning is used as the starting material, the form of the tow is not only remarkably disordered by the repulsive power among single fibers owing to static electricity, but also aggulutination or fusion by the tar-like substance is frequently caused, and it has been difficult to obtain satisfactory carbon fibers.

SUMMARY OF THE INVENTION

Under such circumstances, we researched intensively to correct the above-mentioned defects and to obtain carbon fibers of high quality. As a result, we have found that, by introducing into acrylic fibers, a specific silicone oil and a substance which has an ability for preventing electric charge and which produces no substantial pitch- or tar-like substance, and then thermally stabilizing the fibers, it is possible to obviate all such troubles as fluffiness, spreading, filament breakage, etc. of the precursor fibers, and at the same time, it is possible to markedly heighten the operational stability in the production of carbon fibers. The present invention is based on this discovery.

Therefore, the main object of the present invention is to propose an improved process for producing carbon fibers having excellent physical properties.

Another object of the present invention is to eliminate the above-mentioned troubles such as fluffiness, spreading, filament breakage, etc. and to produce carbon fibers free from agglutination or fusion and having high strength and high modulus of elasticity by a heat treatment in a short time.

Other objects of the present invention will become apparent from the concrete explanation of the invention which will be described hereinafter.

Such objects of the present invention are attained by thermally stabilizing and carbonizing or further graphitizing acrylic fibers containing 0.1-5 weight %, based on the weight of the fibers, of a straight chain silicone substance (hereinafter referred to as silicone oil) and further containing 0.1-5 weight %, based on the weight of the fibers, of a chemical substance (hereinafter referred to as specific oil) which is selected from glycerine, polyethylene glycol, polypropylene glycol, alkyl derivatives thereof, mixtures or compounds of two or more of these substances, and which generates only a residue less than 5 weight % under the action of heat at 240° C. for one hour.

DETAILED DESCRIPTION OF THE INVENTION

By introducing two kinds of the specific treating substances into the structure of acrylic fibers (by fixing them on the surface of the fibers and/or by causing them to be contained in the fibers), it has become possible to suppress the generation of static electricity of the fibers and to give suitable bundling properties to the fibers, thereby preventing the generation of fluff in the thermal stabilization step and the winding of the fibers around the guides and rollers, and to markedly suppress the agglutination or fusion among the fibers, thereby preventing the generation of fluff and the winding of the fibers around the rollers and guides in the subsequent carbonizing step. These are outstanding characteristics of the present invention. In other words, the technical effects peculiar to the present invention are produced by the synergetic effect of two kinds of the specific treating substances. If one of said substances is not present, the objects of the present invention cannot be attained. Particularly in the case of tows of acrylic fibers, the synergetic effect is remarkable. Namely in respect to precursor fibers in tow form, the fibers after spinning are once packed in boxes or wound on spools, and then subjected to thermal stabilization, followed by the carbonization step. Upon such packing of tows into boxes, winding of them on spools or taking them out of these, the tows generate no substantial static electricity because of the treatment of two kinds of the specific substances of the present invention. Therefore, the handling of the tows becomes easier, and finally there is shown the merit of producing carbon fibers free from agglutination or fusion and having excellent physical properties.

The acrylic fibers used in the present invention are those produced from acrylonitrile homopolymers or acrylonitrile copolymers containing combined therewith at least 85 mol % acrylonitrile, preferably more than 90 mol %. As the copolymerization components, there can be mentioned known, unsaturated vinyl compounds copolymerizable with acrylonitrile, such as allyl alcohol, oxypropioacrylonitrile, methacrylonitrile, acrylic acid, methacrylic acid, itaconic acid, methyl acrylate, methyl methacrylate, acrylamide, N-methylolacrylamide, etc. Such acrylonitrile homopolymers or acrylonitrile copolymers are generally produced in a known polymerization system, such as solution polymerization system, bulk polymerization system, emulsion polymerization system, or suspension polymerization system. As the solvents used upon producing acrylic fibers from these polymers, there are used organic solvents such as dimethylformamide, dimethylacetamide, dimethyl sulfoxide, etc.; inorganic solvents such as nitric acid, aqueous solutions of zinc chloride, aqueous solutions of thiocyanates, etc. The polymers are spun into fibers in the usual way.

The silicone oils used in the present invention are those shown by the following formula, and are liquids having a viscosity (at room temperature) of 50–1,000,000 centipoises, preferably 100–10,000 centipoises.

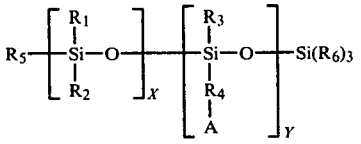

wherein each of $R_1$, $R_2$ and $R_3$ represents hydrogen, methyl, ethyl or phenyl, $R_4$ stands for $-C_nH_{2n}-$(n is an integer from 1 to 10) or phenylene, each of $R_5$ and $R_6$ represents hydrogen or $-C_nH_{2n+1}$ (n is an integer from 1 to 5), each of X and Y is an integer from 1 to 100,000 ($X+Y>10$), and A represents hydrogen, $-(C_2H_4O)_mH$, $-(C_3H_6O)_nH$, (each of m and n is an integer from 1 to 10),

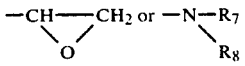

wherein each of $R_7$ and $R_8$ is hydrogen, phenyl or alkyl having not more than 10 carbon atoms.

It is necessary that the silicone oil should be given to acrylic fibers in an amount of 0.1–5 weight % based on the weight of the fibers. With an amount less than 0.1 weight %, it is difficult to display the effect of the present invention sufficiently. However, even if too large an amount of the silicone oil is given to the fibers, a higher effect cannot be produced, and therefore such an amount is unprofitable from the viewpoint of economy. Accordingly, it is necessary that the upper limit of the amount of the silicone oil to be given to the fibers should be 5 weight % based on the weight of the fibers.

The specific oils to be given to the fibers together with said silicone oils are selected from glycerine, polyethylene glycol, polypropylene glycol, alkyl derivatives thereof, mixtures or compounds of two or more of these substances. As the alkyl derivatives, there can be mentioned ether compounds with alcohols such as methyl alcohol, ethyl alcohol, propyl alcohol, butyl alcohol, pentanol, hexanol, etc. and ester compounds with lower carboxylic acids or oxycarboxylic acids such as formic acid, acetic acid, oxalic acid, malonic acid, succinic acid, butyric acid, lactic acid, malic acid, etc. The mixture means a mere mixture of the above-mentioned substances, and the compound means, for example, a block-copolymer of polyethylene glycol with polypropylene glycol.

The specific oils used in the present invention must be those that generate no substantial residue or if any, a very slight amount of residue, under a predetermined action of heat. That is to say, the specific oils must be selected from those that give an amount of residue less than 5 weight %, when the oils are exposed to a temperature of 240° C. for one hour.

Results of residue tests (240° C.×1 hour) made for some of the oils of the present invention and usual spinning oils are given below:

| Substances tested | Residue after heat decomposition (%) |
|---|---|
| Sodium stearate | 50–70 |
| Sodium oleate | 50–70 |
| Sodium laurate | 50–70 |
| Sodium salt of lauryl phosphate/polyethylene oxide addition product | 50–70 |
| Mixture of sorbitan monolaurate/ethylene oxide addition product and polyethylene glycol oleic acid ester (50/50) | 60 |
| Sodium sulfosuccinic acid diisooctyl ester | 40–50 |
| Polyethylene glycol (400) lauric acid ester | 40–50 |
| Polyethylene glycol (400) stearic acid ester | 30–40 |
| Polyethylene glycol (100) oleic acid ester | 30–40 |
| Glycerine monooleic acid ester ethylene oxide addition product | 20–30 |
| Alkyl phenol ether ethylene oxide addition product | 20–30 |
| Glycerine | 0 |
| Dipropylene glycol | 0 |
| Polypropylene glycol (1,000) | 0.1 |
| Polypropylene glycol (4,000) | 0.2 |
| Polyethylene glycol (400) | 1.6 |
| Polyethylene glycol (2,000) | 2.2 |
| Polyethylene glycol (400) glycerine ether | 0.5 |
| Polyethylene glycol (400) dipropylene ether | 1.2 |
| Glycerine monoacetic acid ester | 0.3 |
| Polyethylene glycol (1,000)/polypropylene glycol (2,000) block copolymer | 0.7 |
| Polypropylene glycol (2,000) diisoamyl ether | 3.5 |

The residue tests were carried out as follows:

Ten grams of the oil to be tested is put into a flat dish made of aluminum, 8.5 cm in diameter and 1.0 cm in depth, and is then heated in a hot air current drying apparatus at 240° C. and at an air current velocity of 2 m/sec. for one hour. The weight of the residue (X g) is accurately measured, and the decomposition residue (%) is evaluated by the following formula:

$$\text{Decomposition residue (\%)} = (X/10) \times 100$$

It goes without saying that the specific oils according to the present invention are not limited to the above-mentioned ones shown in the residue tests, and other oils satisfying said two requirements can be advantageously employed, as mentioned previously. It is necessary to introduce such a specific oil into acrylic fibers finally in an amount of 0.1–5 weight % based on the weight of the fibers. If the amount of the oil is less than 0.1%, the objects of the present invention cannot be effectively attained, and in case the amount exceeds 5%, the fibers become sticky or soil the thermal stabilization oven or rollers, and therefore such amounts are not desirable.

To introduce the silicone oil and the specific oil into acrylic fibers in the present invention, combinations of the following methods are suitably used, whereby the silicone oil and the specific oil can be dispersed and introduced into the acrylic fibers before thermal stabilization treatment.

A method wherein the silicone oil and/or the specific oil are added to the spinning solution and then the spinning solution is spun; a method wherein acrylic fibers in a water-swollen state obtained by spinning are treated with the silicone oil and/or the specific oil so that these oils are contained in the fibers; a method wherein acrylic fibers after drying and before thermal stabilization are treated with the silicone oil and/or the specific oil so that these oils are contained in the fibers; etc. The amount of introduction can be attained by suitably deciding the amounts of the silicone oil and the specific oil to be added.

As for the application means for the silicone oil the specific oil used in the present invention, the acrylic fibers can be treated, in accordance with the above-mentioned methods, with an aqueous solution of these oils or a solution in which these oils are dissolved in a low boiling point solvent such as acetone, carbon tetrachloride, benzene, etc.

Upon producing carbon fibers from the acrylic fibers containing such a particular silicone oil and specific oil, any conventional, known heat treating methods may be employed. But in general, there is employed a heat treating method consisting of a thermal stabilization step in which the fibers are heated in an oxidizing atmosphere at a temperature between 200° C. and 350° C. and a carbonization step in which the fibers are heated in a non-oxidizing atmosphere or under reduced pressure at a higher temperature above 800° C. As the thermal stabilization atmosphere, air is preferred, but other methods can be employed in which the fibers are thermally stabilized in the presence of sulfur dioxide gas or nitrogen monoxide gas, or under irradiation of light. As the carbonization atmosphere, nitrogen, hydrogen, helium, argon, etc. are used by preference. To produce carbon fibers with higher strength and higher modulus of elasticity, it is desirable to heat the fibers under tension (generally 0.1–0.5 g/d). Especially, it is effective to apply tension upon thermal stabilization treatment and upon carbonization or graphitization treatment.

For a better understanding of the present invention, representative examples are shown in the following. In the examples, percentages and parts are by weight unless otherwise indicated.

EXAMPLE 1

A spinning solution prepared by dissolving an acrylonitrile copolymer consisting of 98.5 mol % acrylonitrile and 1.5 mol % methacrylic acid in a 50% aqueous sodium thiocyanate solution, was extruded through a spinnerette (having 40,000 spinning holes) into a 12% aqueous sodium thiocyanate solution to coagulate the spinning solution into fibers. The fibers were then washed with water, cold-stretched, and further stretched 4 times in length in boiling water to obtain a water-swollen acrylic fiber tow with a water content of 135%. Thereafter, the water-swollen fiber tow was immersed into an aqueous dispersion of polydimethylaminosiloxane (1,500 centipoises at 25° C.) and was then dried at 120° C. In this way, an acrylic fiber tow of a single-filament fineness of 1.5 denier containing the above-mentioned aminosiloxane in an amount of 0.3% was obtained.

Thereafter, this tow was immersed in an aqueous solution of polyethylene glycol (400) and the mangle squeeze ratio was regulated to produce Sample No. 1 to No. 6 shown in Table 1. These acrylic fiber samples were supplied to a heating oven (180° C.) through guides and rollers, and further supplied to the thermal stabilization step. The state of static electricity generation and the operational condition during this step are also set forth together in Table 1.

TABLE 1

| Sample No. | Amount of the specific oil introduced (%) | Static electricity generation | Operational condition |
|---|---|---|---|
| 1 | 0.05 | A little large | Considerably bad |
| 2 | 0.1 | No generation | Good |
| 3 | 0.25 | " | " |
| 4 | 0.50 | " | " |
| 5 | 4.80 | " | " |
| 6 | 10.20 | " | A little bad; rollers were soiled. |
| 7 | 0 | Remarkable | Remarkably bad |

From the results in Table 1, it is understood that good operational condition was obtained only when the prescribed amounts of the two kinds of the specific oils according to the present invention were introduced into the fibers.

EXAMPLE 2

The acrylic fibers of Sample Nos. 3 and 5 shown in Example 1 were continuously supplied to the heating oven used in Example 1 so that the residence time of the fibers in said oven should be 3 minutes. The fibers were further introduced into a thermal stabilization oven at 240° C. to object the fibers to thermal stabilization treatment for 60 minutes, and then the fibers were subjected to carbonization treatment in a nitrogen atmosphere at 300°–800° C. for 2 minutes and at 800°–1300° C. for 1 minute.

On the other hand, fibers (Sample No. 8) prepared by causing the acrylic fibers of Sample No. 7 shown in Example 1 to ontain a mixed oil of polyethylene glycol (1000) sorbitan monolaurate/polyethylene glycol (400) oleic acid ester (50/50) in an amount of 0.45%, and fibers (Sample No. 9) prepared by causing the same acrylic fibers of Sample No. 7 to obtain lauric acid ethylene oxide addition product in an amount of 0.4%, where carbonized by the same method as above. The physical properties of the carbon fibers thus obtained are shown in Table 2.

TABLE 2

| Sample No. | Carbon fibers Tensile modulus | Tensile strength | Appearance |
|---|---|---|---|
| 3 | 24.6 ton/mm$^2$ | 288 kg/mm$^2$ | No fluff |
| 5 | 24.3 ton/mm$^2$ | 297 kg/mm$^2$ | No fluff |
| 8 | 22.7 ton/mm$^2$ | 209 kg/mm$^2$ | Much fluff |
| 9 | 21.5 ton/mm$^2$ | 182 kg/mm$^2$ | Much fluff |

During the heat treatment of Sample No. 8 and No. 9, a pitch- or tar-like substance was produced owing to the oil used, and consequently agglutination or fusion among the carbon fibers was caused, and yarn breakage occurred frequently.

EXAMPLE 3

By employing the same method as in Example 1 except that the silicone oils shown in Table 3 were used in place of the polydimethylaminosiloxane used in Example 1, dry acrylic fiber tows were obtained.

The amounts of the silicone oils contained in the fibers are shown in Table 3. Thereafter, the dry fibers were immersed into the aqueous solutions of glycerine described in Table 3 (the glycerine contents in the fibers were varied as in Table 3). In this way, acrylic fiber tows of Sample No. 10 to No. 21 were produced. Thereafter, these acrylic fiber tows were carbonized by the method of Example 2.

The physical properties of the thus-obtained carbon fibers and the state of static electricity generation in the heat treatment step are shown in Table 3.

TABLE 3

| Sample No. | Kind of silicone oil and content (%) | Glycerine content (%) | Carbon fibers Tensile modulus | Tensile strength | Static electricity generation |
|---|---|---|---|---|---|
| 10 | Silicone A 0.52 | 0.60 | 24.8 ton/mm$^2$ | 258 kg/mm$^2$ | No |
| 11 | Silicone A 5.35 | 0.60 | 22.5 ton/mm$^2$ | 245 kg/mm$^2$ | No |
| 12 | Silicone B 0.43 | 0.60 | 24.3 ton/mm$^2$ | 275 kg/mm$^2$ | No |
| 13 | Silicone B 0.43 | 0.05 | 23.8 ton/mm$^2$ | 252 kg/mm$^2$ | Much |
| 14 | Silicone C 0.35 | 0.50 | 23.7 ton/mm$^2$ | 263 kg/mm$^2$ | No |
| 15 | Silicone C 0.35 | 5.28 | 23.5 ton/mm$^2$ | 235 kg/mm$^2$ | No |
| 16 | Silicone D 0.47 | 0.80 | 24.5 ton/mm$^2$ | 280 kg/mm$^2$ | No |
| 17 | Silicone D 5.35 | 5.28 | 22.8 ton/mm$^2$ | 242 kg/mm$^2$ | No |
| 18 | Silicone E 0.34 | 0.80 | 24.2 ton/mm$^2$ | 256 kg/mm$^2$ | No |
| 19 | Silicone E 0.05 | 0.05 | 22.3 ton/mm$^2$ | 185 kg/mm$^2$ | Much |
| 20 | Silicone A 0.50 | 0.50 | 24.6 ton/mm$^2$ | 256 kg/mm$^2$ | No |
| 21 | Silicone A 0.05 | 0.50 | 22.2 ton/mm$^2$ | 190 kg/mm$^2$ | Much |

| Note: | | |
|---|---|---|
| Silicone A | Polydimethylsiloxane | 500 centipoises at 25° C. |
| Silicone B | Polymethylphenylsiloxane | 150 centipoises at 25° C. |
| Silicone C | Methylhydrogen polysiloxane | 100 centipoises at 25° C. |
| Silicone D | Polydimethylsiloxane ethylene oxide propylene oxide block copolymer | 3500 centipoises at 25° C. |
| Silicone E | Polydimethylsiloxane epoxy derivative | 200 centipoises at 25° C. |

As shown in Table 3, it is clearly understood that in every case wherein the amounts introduced of the silicone oils and the specific oils are within the range recommended in the present invention, high quality carbon fibers can be obtained, and that the winding of the fibers around the guides and rollers in the carbonization step does not occur at all, so that the operational condition can be remarkably stabilized.

EXAMPLE 4

A spinning solution obtained by dissolving the same acrylonitrile copolymer used in Example 1 in a 50% aqueous sodium thiocyanate solution, was extruded through a spinnerette once into air, and thereafter it was introduced into a 13% aqueous sodium thiocyanate solution to coagulate it into fibers. The fibers were then washed with water, and stretched in hot water to obtain water-swollen fibers. Thereafter, the water-swollen fibers were immersed into an aqueous mixed dispersion of the polydimethylaminosiloxane as used in Example 1 and polyethylene glycol, and then the fibers were dried at 120° C. In this way, acrylic fibers (Sample No. 22), 1.3 deniers in single-filament denier, containing the above-mentioned aminosiloxane and polyethylene glycol in amounts of 0.47% and 0.35%, respectively. The fibers were then stretched 20% in a heating oven at 220° C., and were subjected to a thermal stabilization treatment at 245° C. for 30 minutes and 260° C. for 15 minutes, followed by carbonization.

The physical properties of the thus obtained fibers were excellent, the modulus of elasticity being 25.3 ton/mm$^2$, and the strength being 371 kg/mm$^2$. Upon supplying the thermally stabilized fibers to the carbonization oven, there was no generation of fluff or no winding of the fibers around the guides and rollers. Thus, it was possible to produce carbon fibers having an excellent appearance.

What I claim is:

1. An improved process for producing carbon fibers characterized by thermally stabilizing and carbonizing or graphitizing acrylic fibers containing 0.1–5 weight %, based on the weight of the fibers, of a straight chain silicone substance and further containing 0.1–5 weight %, based on the weight of the fibers, of a chemical substance which is selected from glycerine, polyethylene glycol, polypropylene glycol, alkyl derivatives thereof, and mixtures or compounds of two or more of these substances, and which generates only a residue less than 5 weight % under the action of heat at 240° C. for one hour.

2. A process as claimed in claim 1 wherein the straight chain silicone substance is represented by the formula:

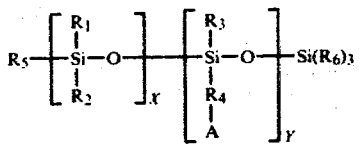

wherein each of $R_1$, $R_2$ and $R_3$ represents hydrogen, methyl, ethyl or phenyl, $R_4$ stands for $-C_nH_{2n}-$ (n is an integer from 1 to 10) or phenylene, each of $R_5$ $R_6$ represents hydrogen or $-C_nH_{2n+1}$ (n is an integer from 1 to 5), each of X and Y is an integer from 1 to 100,000 ($X+Y>10$), and A represents hydrogen, $\text{-}(C_2H_4O)_mH$, $\text{-}(C_3H_6O)_nH$ (each of m and n is an integer from 1 to 10),

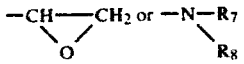

wherein each of $R_7$ and $R_8$ is hydrogen, phenyl or alkyl having not more than 10 carbon atoms.

3. A process as claimed in claim 1 wherein the alkyl derivative is selected from the group consisting of ether compounds with alcohols.

4. A process as claimed in claim 3 wherein the alcohols are selected from the group consisting of methyl alcohol, ethyl alcohol, propyl alcohol, butyl alcohol, pentanol, and hexanol.

5. A process as claimed in claim 1 wherein the alkyl derivative is selected from the group consisting of ester compounds with lower carboxylic acids or oxycarboxylic acids.

6. A process as claimed in claim 5 wherein the carboxylic acids are selected from the group consisting of formic acid, acetic acid, oxalic acid, malonic acid, succinic acid, butyric acid, lactic acid, and malic acid.

7. A process as claimed in claim 1 wherein the acrylic fibers are those of acrylonitrile homopolymers or copolymers which contain at least 85% by weight of acrylonitrile.

8. A process as claimed in claim 1 wherein said silicone substance and/or said chemical substance is introduced in the acrylic fibers before or after the formation of the fibers.

9. A process as claimed in claim 8 wherein said silicone substance and/or chemical substance is used in the form of an aqueous dispersion or organic solvent solution for the introduction into the acrylic fibers.

* * * * *